US007700038B2

(12) United States Patent
Soran et al.

(10) Patent No.: US 7,700,038 B2
(45) Date of Patent: Apr. 20, 2010

(54) FORMED ARTICLES INCLUDING MASTER ALLOY, AND METHODS OF MAKING AND USING THE SAME

(75) Inventors: Timothy F. Soran, Richland, WA (US); Matthew J. Arnold, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 641 days.

(21) Appl. No.: 11/085,407

(22) Filed: Mar. 21, 2005

(65) Prior Publication Data

US 2006/0207387 A1 Sep. 21, 2006

(51) Int. Cl.
*C22C 1/03* (2006.01)
*C22C 1/10* (2006.01)

(52) U.S. Cl. ..... 420/590; 75/305; 75/321; 75/228; 75/746; 75/764; 75/772; 420/580; 423/71; 419/61

(58) Field of Classification Search ..... 75/305, 75/321, 228, 746, 764, 772; 420/590, 580; 423/71; 419/61
See application file for complete search history.

(56) References Cited

U.S. PATENT DOCUMENTS

| | | | | |
|---|---|---|---|---|
| 323,502 | A | 8/1885 | Edwards | |
| 3,433,626 | A * | 3/1969 | Bomberger, Jr. | 75/10.26 |
| 3,768,999 | A | 10/1973 | Ohkubo et al. | |
| 4,412,872 | A | 11/1983 | Albrecht et al. | |
| 4,880,462 | A | 11/1989 | Meyer-Grünow | |
| 5,011,798 | A | 4/1991 | Sasabe et al. | |
| 5,368,630 | A * | 11/1994 | Luk | 75/252 |
| 5,670,726 | A | 9/1997 | Kolaska et al. | |

(Continued)

FOREIGN PATENT DOCUMENTS

| | | | |
|---|---|---|---|
| DE | 3303680 | A1 | 8/1984 |

(Continued)

OTHER PUBLICATIONS

ASM Handbooks Online, vol. 15, "Casting Methods". pp. 1-5. 2002.*

(Continued)

*Primary Examiner*—Roy King
*Assistant Examiner*—Tima M McGuthry-Banks
(74) *Attorney, Agent, or Firm*—Kirkpatrick & Lockhart Preston Gates Ellis LLP; Patrick J. Viccaro; John E. Grosselin, III

(57) ABSTRACT

A formed article for making alloying additions to metal melts includes particles of at least one master alloy and a binder material binding the particles of the master alloy in the formed article. The binder material changes form and frees the master alloy particles when the formed article is heated to a predetermined temperature, preferably a temperature greater than 500° F. A method for making an alloy also is provided. The method includes preparing a melt comprising a predetermined quantity of a master alloy wherein the master alloy is added to the melt or the melt starting materials in the form of particles of the master alloy bound into at least one formed article by a binder material that decomposes at a predetermined temperature, preferably a temperature greater than 500° F., and releases the particles of master alloy.

74 Claims, 4 Drawing Sheets

U.S. PATENT DOCUMENTS

| | | | | |
|---|---|---|---|---|
| 5,733,644 | A | 3/1998 | Tanaka et al. | |
| 5,800,746 | A | 9/1998 | Jones et al. | |
| 5,807,547 | A | 9/1998 | Wong | |
| 5,833,893 | A | 11/1998 | Jones et al. | |
| 5,834,089 | A | 11/1998 | Jones et al. | |
| 5,869,551 | A | 2/1999 | Caswell et al. | |
| 5,889,089 | A | 3/1999 | Caswell et al. | |
| 5,955,516 | A | 9/1999 | Caswell et al. | |
| 6,149,710 | A * | 11/2000 | Gonzalez et al. | 75/684 |
| 6,232,371 | B1 | 5/2001 | Caswell et al. | |
| 6,251,159 | B1 * | 6/2001 | Angeliu et al. | 75/414 |
| 6,322,608 | B1 * | 11/2001 | Haug et al. | 75/235 |
| 6,410,614 | B1 | 6/2002 | Jones et al. | |
| 6,436,550 | B2 * | 8/2002 | Sakata et al. | 428/553 |
| 6,506,338 | B1 | 1/2003 | Gedevanishvili et al. | |
| 7,153,339 | B2 * | 12/2006 | Lindsley et al. | 75/255 |
| 2002/0049278 | A1 | 4/2002 | Jones et al. | |
| 2003/0047463 | A1 | 3/2003 | Ward-Close et al. | |

FOREIGN PATENT DOCUMENTS

| | | | |
|---|---|---|---|
| EP | 0 776 638 A2 | | 4/1997 |
| RU | 1822444 A 3 | * | 6/1993 |

OTHER PUBLICATIONS

"Thermosets" Encyclopedia of Polymer Science and Technology: Wiley InterScience. vol. 12, pp. 207 and 208. 2002.*

Human translation of SU 1,822,444 published Jun. 15, 1993.*

"Effects of PEG molecular weights on rheological behavior of alumina injection molding feedstocks", Materials Chemistry and Physics 78 (2002) pp. 416-424.

"Characteristics of PLPP and infiltration of attrition-milled waster-$Al_2O_3$ substrates with cullet", Journal of Ceramic Processing Research, vol. 2, No. 2, pp. 87-91 (2001).

* cited by examiner

FORMED ARTICLES INCLUDING MASTER ALLOY, AND METHODS OF MAKING AND USING THE SAME

BACKGROUND OF THE TECHNOLOGY

1. Field of Technology

The present disclosure relates to articles including master alloy, and to certain methods of making and using those articles. More particularly, the present disclosure relates to formed articles including master alloy used for making alloying additions to a metal melt, and to certain methods of making and using such formed articles.

2. Description of the Background of the Technology

During production of stainless steel, titanium alloys, and other alloys, quantities of raw feed materials, often including scrap, are heated at high temperature to produce a melt having the desired elemental chemistry. It is often the case that quantities of one or more master alloys are added to the raw feed materials or to the melt to suitably adjust the elemental chemistry of the melt prior to solidifying the melt into an ingot, a billet, a powder, or some other form. As is known in the art, a master alloy is an alloy rich in one or more desired addition elements and is included in a metal melt to raise the percentage of the desired constituent in the melt. *ASM Metals Handbook*, Desk Edition (ASM Intern. 1998), p. 38.

Because the elemental composition of the master alloy is known, it theoretically is simple to determine what amount of a master alloy must be added to achieve the desired elemental chemistry in the melt. However, one must also consider whether all of the added quantity of the master alloy will be fully and homogenously incorporated into the melt. For example, if the actual amount of the master alloy addition that melts and becomes homogenously incorporated into the melt is less than the amount added, the elemental chemistry of the melt may not match the desired chemistry. Thus, an effort has been made to develop forms of master alloys that will easily melt and readily become homogenously incorporated into a metal melt.

One example of a specific area presenting some challenge is the introduction of certain alloying additives into a titanium melt. For example, it is difficult to alloy titanium with oxygen. Titanium sponge or cobble typically is used as the titanium-rich raw feed material when preparing titanium alloy melts. A conventional method of increasing the oxygen content of a titanium alloy melt involves compacting titanium sponge with powdered titanium dioxide ($TiO_2$) master alloy. As the titanium dioxide master alloy dissolves and becomes incorporated into the melt, it increases the oxygen content of the molten material, and subsequently also increases the oxygen content of the solid material formed from the melt. The process of compacting the sponge and titanium dioxide powder has several drawbacks. For example, it is costly to weigh out and compact the materials. Also, preparing the compacted sponge and titanium dioxide powder requires a significant amount of time prior to the melting and solidifying/casting process.

A known alternative method for adding oxygen to a titanium melt is simply to mix a quantity of a loose powdered titanium dioxide master alloy with the titanium sponge and/or cobble raw feed materials in the melting vessel prior to heating the materials. In this method, relatively small amounts of the powdered titanium dioxide coat the surfaces of the sponge and/or cobble. If more of the powdered titanium dioxide is added, it will fail to stick to the starting materials and will segregate from those materials. This "free" titanium dioxide powder is prone to be carried away by air movement. Also, large portions of loose titanium dioxide powder that collect in the melting vessel may not be homogenously incorporated into the melt. Accordingly, a possible result of using this conventional titanium dioxide addition technique to adjust the chemistry of a titanium alloy melt is an inconsistent and unpredictable loss of titanium dioxide. The final result can be a titanium alloy product that does not have the expected elemental chemistry.

Given the above, titanium alloy producers typically use the alloying technique of adding loose powdered titanium dioxide when producing titanium alloys having small oxygen additions. Nevertheless, even in such cases the final level of oxygen achieved is somewhat unpredictable. When higher oxygen levels are desired than can be readily achieved by the addition of loose titanium dioxide powder, the titanium sponge/titanium dioxide powder compaction technique is often used, with the aforementioned lead time and cost disadvantages.

Given the drawbacks of conventional techniques of adding alloying oxygen to titanium melts, it would be advantageous to provide an improved alloying technique. More generally, it would be advantageous to provide an improved general technique for making various alloying additions to a wide variety of metal melts.

SUMMARY

In order to provide the advantages noted above, according to one aspect of the present disclosure a formed article is provided for making alloying additions to metal melts. The formed article includes particles of at least one master alloy, and a binder material binding the particles of the master alloy in the formed article. The binder material change form and frees the master alloy particles when the formed article is heated to a predetermined temperature. Preferably, the predetermined temperature is a temperature that is greater than 500° F.

According to another aspect of the present disclosure, a method is provided for making an article used for alloying a metal melt. The method includes providing a substantially homogenous mixture comprising master alloy particles and a binder material. An article is formed from at least a portion of the mixture. The article includes master alloy particles bound in the formed article by the binder material. The binder material changes form and frees the master alloy particles when the article is heated to a predetermined temperature. Preferably, the predetermined temperature is a temperature that is greater than 500° F.

According to a further aspect of the present disclosure, a method of making an alloy is provided. The method includes preparing a melt comprising a predetermined quantity of a master alloy. The master alloy is added to the melt or the melt starting materials in the form of particles of the master alloy bound into at least one formed article by a binder material that decomposes at a predetermined temperature that is greater than 500° F. and releases the particles of master alloy. According to certain non-limiting embodiments of the method, the step of preparing the melt includes providing a substantially homogenous mixture comprising a plurality of the formed articles and the remaining melt ingredients, and heating at least a portion of the homogenous mixture to a temperature above the predetermined temperature.

According to yet an additional aspect of the present disclosure, a method of adjusting the elemental composition of a metal melt is provided. The method involves including in the melt a predetermined quantity of a master alloy-containing material that is in the form of at least one formed article comprising particles of master alloy bound together by at least one organic polymer. The master alloy comprises at least one of titanium, titanium compounds, nickel, nickel compounds, molybdenum, molybdenum compounds, palladium, palladium compounds, aluminum, aluminum compounds, vanadium, vanadium compounds, tin, tin compounds, chromium, chromium compounds, iron, iron oxide, and iron compounds.

The reader will appreciate the foregoing details and advantages, as well as others, upon consideration of the following detailed description of certain non-limiting embodiments of the methods and articles of the present disclosure. The reader also may comprehend such additional advantages and details upon carrying out or using the methods, articles, and parts described herein.

BRIEF DESCRIPTION OF THE DRAWINGS

The features and advantages of the methods and articles described herein may be better understood by reference to the accompanying drawing in which.

DESCRIPTION OF CERTAIN NON-LIMITING EMBODIMENTS

Figure 1:
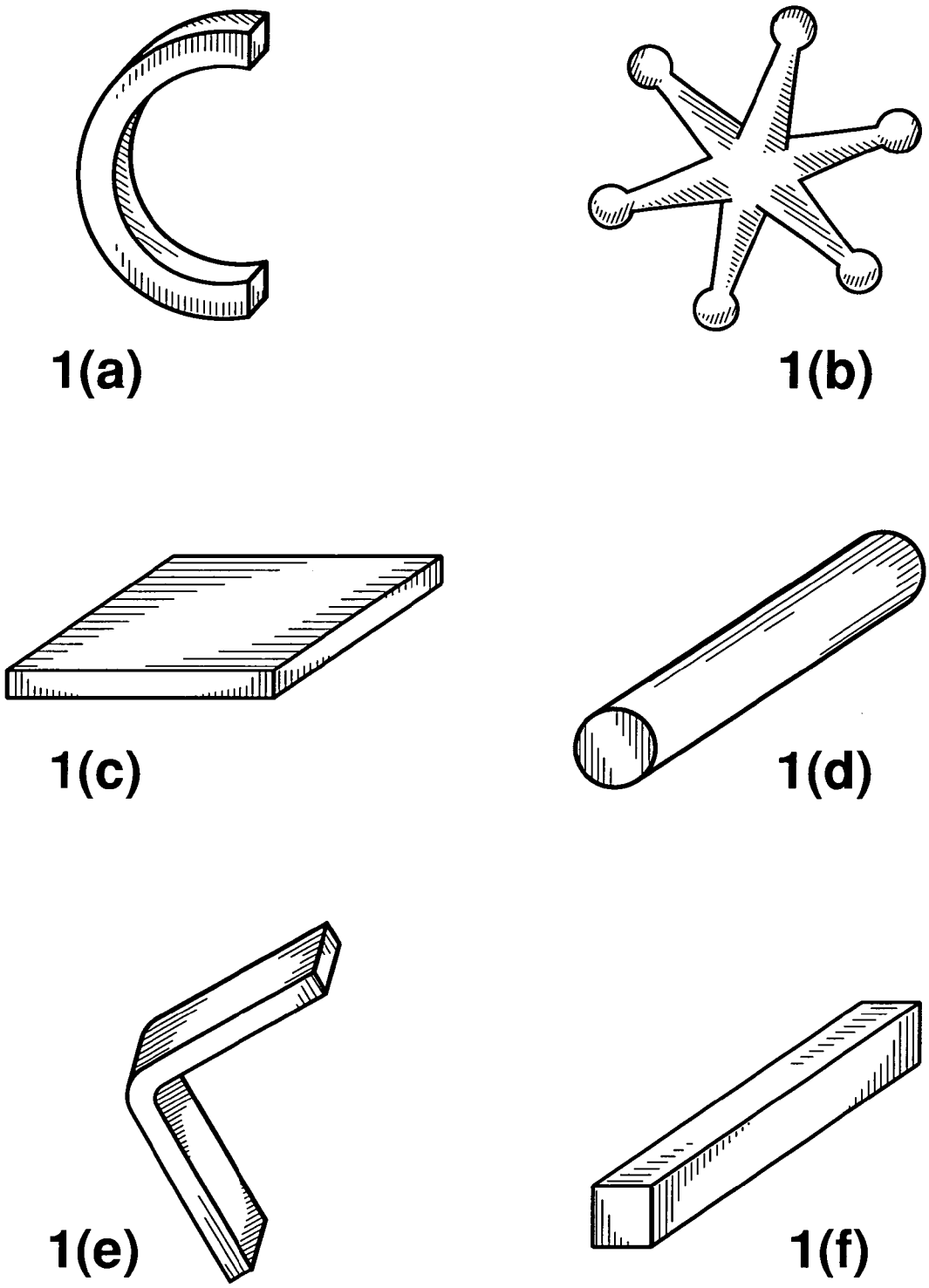
FIGS. 1 (*a*) through 1 (*f*) are illustrations of various non-limiting shapes of formed articles that may be made according to the present disclosure.

Other than in the operating examples, or where otherwise indicated, all numbers expressing quantities of ingredients, processing conditions and the like used in the present description and claims are to be understood as being modified in all instances by the term "about". Accordingly, unless indicated to the contrary, any numerical parameters set forth in the following description and the attached claims are approximations that may vary depending upon the desired properties one seeks to obtain in the formed articles of the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present disclosure are approximations, the numerical values set forth in any specific examples herein are reported as precisely as possible. Any numerical values, however, inherently contain certain errors, such as, for example, operator errors and/or equipment errors necessarily resulting from the standard deviation found in their respective testing measurements. Also, it should be understood that any numerical range recited herein is intended to include the range boundaries and all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Certain non-limiting embodiments according to the present disclosure are directed to formed articles including a quantity of particulate master alloy bound in the formed article by a binder material. As used herein, a "formed article" refers to an article that has been produced by a process including the action of mechanical forces. Non-limiting examples of such processes include molding, pressing, and extruding. In certain embodiments, formed articles according to the present disclosure may be added to the raw feed materials used in preparing a metal melt. In certain other embodiments, the formed articles may be added to the molten material of an existing metal melt. Certain embodiments of the formed articles of the present disclosure may be used in either of these manners. As used herein, a "metal melt" refers to a melt of a metal and, optionally, metal and non-metal alloying additives that is subsequently solidified into an alloy. Without intending to limit the application of the developments described herein to the preparation of any particular alloys, possible alloys that may be made using metal melt ingredients including one or more formed articles according to the present disclosure include titanium alloys, zirconium alloys, aluminum alloys, and stainless steels. Upon considering the present disclosure, those of ordinary skill will be able to readily identify other alloys that can be produced from metal melts made of ingredients including one or more of the formed articles of the present disclosure.

The formed articles of the present disclosure include a quantifiable concentration and/or amount of at least one desired alloying additive, and one or more of the formed articles may be added to metal melt raw feed materials or to the metal melt itself so as to adjust the elemental composition of the melt and provide the solidified articles or material formed from the melt with a desired chemistry. Because the formed articles described herein include binder material having general properties discussed herein, embodiments of the formed articles may be made with an advantageous predetermined shape, density, and/or size. For example, the formed articles may be made with a general size and shape selected so that the articles will homogenously mix with the remaining materials from which the melt is formed and will not exhibit an unacceptable tendency to separate from or segregate within the resulting mixture.

As noted above, embodiments of the formed articles of the present disclosure include a quantity of particulate master alloy. The size and shape of the master alloy particles can be any size and shape suitable as master alloy additive to the particular metal melt of interest. In certain non-limiting embodiments, for example, the particulate master alloy will be in the form of a powder composed of discrete particles of the master alloy having sizes in the range of, for example, submicron to about 20 mm.

In one specific non-limiting embodiment of a formed article according to the present disclosure, the master alloy is a palladium sponge powder having a particle size in the range of about 1 micron up to about 20 mm in diameter. Preferably, such palladium master alloy particles are no larger than about 5 mm in diameter, and more preferably are no larger than about 0.1 mm. Formed articles according to the present disclosure including particulate palladium master alloy of the foregoing particle sizes find application in, for example, titanium alloy melts. Because the melting point of palladium is relatively low compared with titanium, palladium metal melts rapidly in a titanium melt, and there is little concern that palladium master alloys would remain unmelted. Other metal master alloys having melting points near or above the melting point of a melt's predominant metal preferably are of relatively small particle size to facilitate complete melting. A particularly preferred particle size for such other master alloys to facilitate complete melting is about 1 micrometer or less.

In another non-limiting embodiment of a formed article according to the present disclosure, the master alloy is a particulate titanium dioxide or a similar oxide compound, and in such case the particles preferably are less than about 100 micrometers in diameter, and more preferably are less than 1 micrometer in diameter. Such formed articles may be used in, for example, titanium alloy melts in order to add oxygen to the molten material and the resultant solid alloy. The relatively small particle size of the titanium dioxide in such formed articles better assures complete dissolution in the melt. Incomplete dissolution would result in diminished alloying contribution and, more significantly, can result in very undesirable defect particles (inclusions) in the final solidified product.

Other possible particulate master alloys sizes and forms include those in shot form. As the term is used here, "shot" refers to generally spherical particles having a diameter in the range of about 0.5 mm up to about 5 mm. Certain other possible particulate master alloys forms useful in the formed articles of the present disclosure may be of "cobble" size, which herein refers to a wide variety of scrap materials including crumpled and balled sheet, fasteners, trim pieces from many manufacturing process, partially manufactured objects, rejected manufactured objects, and any raw material in that size range, all of which has a maximum size in any one dimension in the range of about 1 mm up to about 100 mm. Accordingly, there may be some overlap in size between what is considered "shot" and what is considered "cobble". The foregoing master alloy particle sizes and shapes should not be considered limitations on what is disclosed herein, and the particulate master alloy may have any particle size, whether smaller or larger than those specifically disclosed herein, that is suitable to allow the master alloy in the formed articles to satisfactorily dissolve in the melt and be incorporated into the final alloy. Accordingly, reference herein to a "particulate" master alloy or master alloy "particles" does not imply any particular particle size or particle size range, or any particular shape. Instead, reference to "particulate", "particles", or the like merely indicates that multiple pieces of the particular master alloy are bound into the formed article by a binder material. Also, it will be apparent upon considering the present disclosure that the master alloy shapes useful in the present formed articles are not limited to those specifically mentioned here. Other possible master alloy shapes that may be used in the formed articles of the present disclosure will be apparent to those of ordinary skill upon considering the present disclosure, and all such master alloys shapes are encompassed within the appended claims.

The chemistries of the one or more master alloys that may be included in the formed articles according to the present disclosure may be any desired and suitable master alloy chemistries. For example, as described further herein, in one non-limiting embodiment of a formed article according to the present disclosure, the master alloy is particulate titanium dioxide, which is a master alloy that, for example, has been used in the past to add oxygen to melts of titanium alloy. Of course, those of ordinary skill will be able to identify one or more particular master alloy chemistries based on the desired alloying effect in connection with the particular metal melt to be prepared. As such, an exhaustive description of the possible particulate master alloy materials useful for forming melts of particular alloys is unnecessary herein. A non-exhaustive list of examples of master alloys available in particulate form that may be used in the formed articles described in the present disclosure includes: palladium master alloys (used in making, for example, ASTM B 348 titanium alloys such as titanium alloy ASTM grades 7 (Ti-0.15Pd), 11 (Ti-0.15Pd), 16 (Ti-0.05Pd), 17 (Ti-0.15Pd), 18 (Ti-3Al-2.5V-0.05Pd), 20 (Ti-3Al-8V-6Cr-4Mo-4Zr-0.05Pd), 24 (Ti-6Al-4V-0.05Pd), and 25 (Ti-6Al-4V-0.5Ni-0.05Pd); palladium compound master alloys; nickel and molybdenum master alloys (used in making, for example, titanium ASTM grade 12 (Ti-0.3Mo-0.8Ni); aluminum and aluminum compound master alloys; vanadium and vanadium compound master alloys; tin and tin compound master alloys; chromium and chromium compound master alloys; and iron, iron oxide (used in making, for example, CP titanium including ASTM grades 1, 2, 3 and 4), and other iron compound master alloys.

The binder materials that may be used in the formed articles of the present disclosure may be any suitable single material or combination of materials that will readily mix with the one or more particulate master alloys and suitably bind the particles into a desired formed article. The particular binder material or materials must have properties such that they will suitably decompose, which means that at the operating parameters of the melting apparatus the one or more binder materials produce volatile species which either can be absorbed into the molten material or pulled out of the melting apparatus by a vacuum system. Given that the focus of the present disclosure is the alloying of metal melts, the selected binder material or materials must decompose and release the bound master alloy particles when the formed article is subjected to high temperature. Preferably, the high temperature is a temperature that is in excess of 500° F.

As an example, during the preparation of titanium alloy melts using a conventional electron beam melting apparatus, the high operating temperatures (about 1670° C. for titanium) and very low pressures (about 1 mTorr) are sufficient to vaporize many of the binder materials contemplated for use in embodiments of formed articles according to the present disclosure. When subjected to such conditions, those binder materials melt and then volatilize, or directly volatilize from a solid state, generating gaseous species that can dissolve into the molten titanium. When the binder decomposes in this way, the bound master alloy particles are released and may be readily absorbed into the melt.

The binder materials also must satisfy certain other requirements discussed herein. Necessarily, only limited examples of possible binder materials are described herein, and it will be understood that those of ordinary skill may readily identify additional suitable binder materials. Such additional binders, although not specifically identified herein, are encompassed within the present invention and the appended claims.

One class of binder materials that may be used in the formed articles is the organic polymers. Depending on the particular metal melt to be prepared, non-limiting examples of possible suitable organic polymer binder materials include ethylene vinyl acetate (EVA), low density polyethylene (LDPE), high density polyethylene (HDPE), urea formaldehyde, and other formaldehyde compounds. More generally, suitable binder materials include any single organic hydrocarbon polymer or combination of organic hydrocarbon polymers that can be suitably formed into self-supporting shapes and satisfy the other binder material requirements set forth herein. Useful organic hydrocarbon polymers include, for example, various thermoset and thermoplastic hydrocarbon polymers commonly available and used in the plastics industry. Mixtures of thermoset and thermoplastic hydrocarbon polymers also may be used as binder materials. The thermoset and thermoplastic materials or mixtures thereof must be able to bind together the particulate master alloy, and also must satisfy the several other requirements described herein. Preferably, a thermoset or thermoplastic binder material or mixture used to produce the formed articles of the present disclosure has good forming and extruding properties, as well as sufficiently low surface tension and viscosity to coat the master alloy particles. Polymers having good wetting and coating properties are preferred because better coating of the master alloy particles allows a higher percentage of the particles to be incorporated into the formed articles. Incomplete coating of the master alloy particles may result in excessive wear on the forming equipment and insufficient structural integrity in the final formed articles. One also must be able to thoroughly and homogenously mix the thermoset and/or thermoplastic binder material with the master alloy particles. Any thermoset binder material used preferably also has good setting and hardening properties so as to produce formed articles of satisfactory strength to maintain sufficient integrity during handling.

The organic polymer or other binder material may be provided in any form suitable for mixing with the particulate master alloy. LDPE and HDPE, for example, as well as numerous other organic polymers, are available in a solid granular form that may be readily mixed with particulate master alloy. The particular binder material or combination of binder materials used preferably are obtained in forms that can readily, thoroughly, and homogenously mix with the particulate master alloy so that the binder material can effectively bind the master alloy particles when the mixture is processed.

Many organic polymers, which by definition include a significant amount of carbon, are well suited for use as binder materials for formed articles according to the present invention, including, for example, formed articles useful for preparing melts of titanium base alloys. The addition of certain levels of carbon to a titanium melt can be tolerated and, up to a point, will advantageously strengthen the resulting titanium alloy. One may readily determine the elemental composition of the binder material used in a particular formed article made according to the present disclosure, and thereby assess whether the binder material and its elemental composition can be tolerated, or perhaps may be advantageous, at certain addition levels once decomposed and absorbed into the melt.

In addition to suitably decomposing at the temperature of the melt, binder materials useful in the various formed articles of the present disclosure preferably do not off-gas when loaded onto a feed system and are being conveyed to the immediate area of the molten pool or otherwise prior to being loaded into the immediate area of the molten pool. In the specific case wherein the melt feed materials are melted in an electron beam melting apparatus, the formed articles of the present disclosure must decompose and off-gas (vaporize) when struck by the electron beam so as to dissolve in the melt, but the articles preferably do not off-gas in the vacuum environment of the electron beam apparatus when at ambient temperatures (such as 10-120° F.).

Another necessary characteristic of the organic polymer or other binder material is that it must not prematurely loose structural integrity or decompose and thereby release the particles of master alloy until an appropriate time so that the master alloy ingredients of the formed article are suitably absorbed into the melt. The organic polymer or other binder material preferably will provide a formed article that is sufficiently resistant to handling, impact and other forces so that the formed article does not break up to an unacceptable degree during handling and result in fines or other relatively small pieces that would be lost or easily segregate within a mix of melt raw feed materials.

Also, the chemistry of the organic polymer or other binder material cannot include elements in concentrations that cannot be tolerated in the particular metal melt and resulting cast alloy. For example, when preparing melts of certain titanium-base alloys, the binder material should not include unacceptable levels of silicon, chlorine, magnesium, boron, fluorine, or other elements that would be undesirable in the melt and resulting cast alloy. Of course, those of ordinary skill may readily determine the suitability of a particular binder material or combination of binder materials through testing, knowledge of the compositions of the binder material and the desired resulting alloy, known incompatibilities of certain elements in the desired alloy, and other means.

As noted, organic polymer binder materials necessarily include significant carbon content. Carbon concentration must be considered when selecting a suitable binder, although the binder concentration of the formed articles must be taken into account as well. When producing titanium-base alloys using organic polymer binder materials, for example, preferably the maximum carbon concentration of the binder is about 50 wt. %. Depending on the binder concentration in the formed articles, binder material carbon concentrations above 50 wt. % may result in the addition of excessive carbon to a titanium alloy melt since most titanium alloy specifications have a carbon limit no greater than 0.04 wt. %. Adding formed articles made according to the present disclosure including particulate titanium dioxide master alloy and certain high-carbon organic polymer binder materials may increase the melt's carbon content to the allowable maximum without adding significant oxygen to the melt.

Nitrogen is another element that may be present in binder materials useful in the formed articles of the present disclosure. Nitrogen addition can improve the properties of certain alloys. For example, nitrogen increases the strength of titanium about 2.5 times more effectively weight-for-weight than oxygen. Thus, for example, one can produce a formed article according to the present disclosure including one or more nitrogen-containing binder materials as a means to add nitrogen as an alloying additive to the titanium melt and improve the strength of the titanium alloy. The one or more nitrogen-containing binder materials may contain, for example, up to 50 wt. % nitrogen, or more. The concentration of particulate oxygen-containing master alloy in such a formed article could be reduced since the nitrogen-containing binder material also acts to improve the strength of the resulting titanium alloy. This allows for a particular degree of strengthening of the titanium alloy using less oxygen-containing master alloy than would be necessary without the nitrogen-containing binder material. Of course, it may also be desirable to add nitrogen to an alloy melt other than titanium, or for reasons other than strengthening. Also, relatively few nitrogen-containing master alloys exist. Using a nitrogen-containing binder material in formed articles made according to the present disclosure addresses these needs.

Possible nitrogen-containing binder materials useful in the formed articles according to the present disclosure include urea formaldehyde, as well as any other suitable nitrogen-containing organic hydrocarbon material that can be formed into shapes and bind together particulate master alloy, including nitrogen-containing thermoset and thermoplastic materials.

The suitable binder concentration range in formed articles according to the present disclosure will depend on a variety of factors, including those considered above. In certain embodiments, the formed article includes a binder material comprising at least about 5% up to about 60% by weight of organic polymer. A limiting factor for the minimum binder material concentration is the ability of a given concentration of chosen binder material to bind the particulate master alloy into a formed article having the desired shape, size and/or density, and with suitable strength so that the formed articles may be handled without being unacceptably damaged. Thus, while chemistry may dictate the maximum binder material concentration, mechanical limitations may dictate the minimum binder material concentration. For example, when producing a certain type of formed article according to the present disclosure including particular particulate titanium dioxide master alloy and LDPE binder materials it was determined that using less than about 18 wt. % LDPE results in articles that do not suitably hold together, and that some portion of the master alloy remained as an unbonded powder in the articles. Therefore, in certain other embodiments, the formed article includes a binder material comprising at least 18% by weight of organic polymer. Also, mixes of master alloy and relatively low concentrations of binder material may damage standard polymer mixing and forming equipment. Nevertheless, at times, chemical considerations, such as lowering the carbon content of the formed articles, may dictate using lower, yet mechanically acceptable, concentrations of binder material in the formed articles.

The formed articles of the present disclosure can be made from one or more particulate master alloys and one or more suitable organic polymer binder materials by any number of methods of forming articles from polymeric materials utilized in the bulk plastics and plastics forming and injection industries and that are known to those having ordinary skill. According to certain non-limiting embodiments of the method of the present disclosure, for example, a quantity of one or more particulate master alloys is mixed with a quantity of one or more organic polymer binder materials to form a substantially homogenous mixture. At least a portion of the homogenous mixture is then processed into a cohesive formed article of a desired shape, size, and density. Any suitable means may be used to combine and mix the ingredients so as to form the substantially homogenous mixture. For example, thermoplastic polymer binder material may be thoroughly and homogenously mixed with particulate master alloy using simple kneaders, rapid mixers, single-screw or twin-screw extruders, Buss kneaders, planetary roll extruders, or rapid stirrers. Thermoset polymer binder material may be thoroughly and homogenously mixed with particulate master alloy using, for example, simple kneaders, rapid mixers, or rapid stirrers. Forming a substantially homogenous mixture may be important to ensure that the binder material can readily bind the particulate master alloy. If, for example, the binder material collects in pockets when attempting to mix the binder material and the particulate master alloy, then when the binder is softened or liquefied during formation of the formed articles, the binder may not insinuate the interstices between all regions of the master alloy particles. This may result in a circumstance in which regions or portions of the master alloy particles are bound insecurely or are not bound at all into the formed article, and this can result in the existence of loose particulate master alloy or mechanically weak formed articles that cannot acceptably withstand handling stresses.

Any suitable process or technique may be used to produce the formed articles from the mixture of master alloy and binder material. For example, in the case where the binder material is an organic polymer provided in the mix as a solid granular material, all or a portion of the mix of particulate master alloy and binder may be heated to soften or liquefy the organic polymer, and then the heated mixture is mechanically formed into a desired shape having a desired density by known forming techniques. Alternately, the heating and forming of all or a portion of the mixture can be done simultaneously. Once the binder material within the formed article cools to a certain point, the binder material hardens and holds together the particulate master alloy. Possible methods of physically forming all or a portion of the mixture into the desired article include casting at or above the melting point of the binder material, die molding, extruding, injection molding, pelleting, and film extruding. More specific non-limiting examples of possible forming techniques include mixing a powdered or pelleted organic polymer binder material with particulate master alloy, and then heating the mixture while extruding the mixture into the desired shape of the formed article. Alternatively, the particulate binder material(s) and master alloy(s) are mixed, the mixture is heated while being extruded, the extrusion is then again run through the extrusion apparatus to further mix the mixture ingredients, and then the doubly extruded mixture is injection molded into the shape of the formed articles.

The formed articles of the present disclosure can have any shape and size suitable for addition to a metal melt or to a mix of raw feed materials (i.e., melt ingredients) prior to melting of the materials to form an ingot or other structure of an alloy. For example, the formed article may have a shape selected from a pellet, a stick, a rod, a bar, a curved shape, a star shape, a branching shape, a polyhedron, a parabola, a cone, a cylinder, a sphere, an ellipsoid, a curved "C" shape, a jack shape, a sheet, and a right angle shape. Preferably, the selected shape is such that the formed articles will loosely interlock with the raw feed materials when mixed in with the materials, and will not separate or segregate. In the specific case of making a titanium alloy melt, for example, the chosen shape preferably is relatively immobile relative to the remaining ingredients when intermixed with the titanium sponge and/or titanium cobble and any other feed materials that may be added to form the metal melt. Segregation of the formed articles from the remaining melt feed materials at any time during the handling of the materials is undesirable. Formed shapes including multiple arms, protrusions, and/or projections, and formed shapes including multiple curves or angles can be advantageous since pieces formed from the master alloy/binder mixture having those shapes typically cannot readily pass down through the melt feed materials or migrate to the top of the feed materials. Several formed article shapes believed to be advantageous are shown in FIGS. 1 (*a*) (curved "C" shape); 1 (*b*) (jack shape); 1 (*c*) (sheet); 1 (*d*) (rods); 1 (*e*) (right angle shapes); and 1 (*f*) (stick shapes).

The desired size of the individual formed articles will, at least to some extent, depend on the intended use of the articles. For example, the size of the raw feed materials to be included in the melt may have some bearing on the desired size of the formed articles: it may be advantageous to provide the formed articles in a size approximating that of the melt's raw feed materials to better ensure that the melt ingredients mix homogenously and the formed articles do not have an unacceptable tendency to segregate from the mixture during handling. Although the formed articles may have any suitable size, in certain non-limiting embodiments, formed articles according to the present disclosure provided in particulate form (in contrast to formed articles in the shape of long bars and rods, for example) used in the preparation of titanium alloy melts generally should have a diameter no greater than about 100 mm, more preferably no greater than about 3 mm, and even more preferably no greater than about 1 mm. In another non-limiting embodiment, the formed articles are provided in a sheet form that is useful in, for example, forming titanium alloy melts from ingredients including bars of compressed titanium scrap materials. In such case, the sheets may be, for example, about 10 to about 1000 mm wide and about 0.5 to about 10 mm thick.

In connection with the addition of oxygen to titanium melts, it has been observed that, in general, titanium dioxide and organic polymer binders such as EVA, LDPE and HDPE may be used to produce formed articles according to the present disclosure having a density similar to titanium. This similarity can be helpful in preventing segregation of the formed articles from homogenous mixtures of the formed articles and titanium raw feed starting materials, such as titanium sponge and cobble. Raw titanium scrap and sponge typically come in sizes ranging from powder size to polyhedrons of about 1500 mm in diameter. Accordingly, formed articles can be made from titanium dioxide and binder material according to the present invention with similar sizes so as to further inhibit segregation of the formed articles from a homogenous mixture of the formed articles and the titanium feed materials.

Iron also is a common alloy addition to titanium and certain other alloys, such as aluminum alloys. Since both iron and oxygen are commonly added to alloy titanium and certain other alloys, it seems to follow that iron oxides would be advantageous master alloys. Iron oxides also are quite inexpensive. Combining iron oxide and titanium, however, can spontaneously result in a violent, exothermic thermite reaction. (The thermite reaction is utilized in certain incendiary explosives.) An advantage of making formed articles according to the present disclosure including particulate iron oxide master alloy and a binder coating the iron oxide particles and binding them together is that this can prevent the thermite reaction from occurring. Thus, producing formed articles including a binder material according to the present disclosure can make the addition of iron oxide master alloy to titanium safe when alloying titanium.

Figure 2:
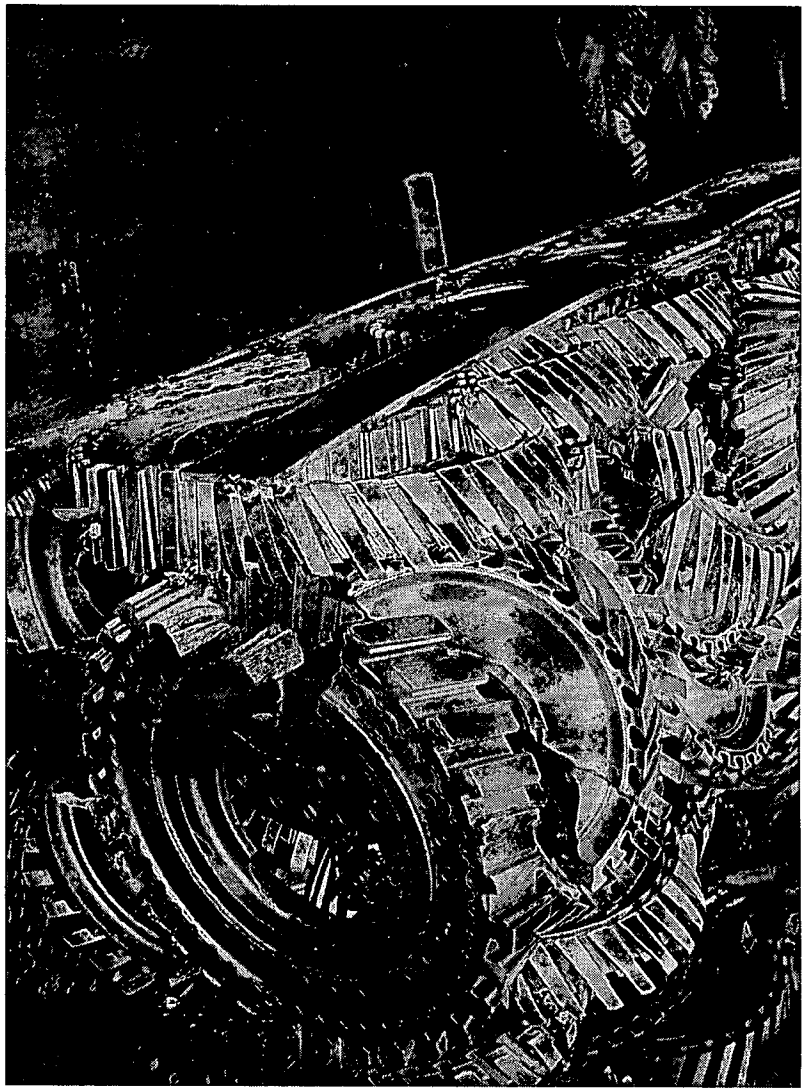
FIG. 2 is a photograph of a conventional bar-shaped assemblage of titanium scrap materials used to form a titanium alloy melt.

In certain methods of preparing melts of titanium alloy, large bar-shaped assemblages of titanium scrap feed material are prepared and are incrementally fed into a heated furnace. FIG. 2 is a photograph of one such "bar" wherein the predominant scrap feed materials are scrap titanium gears that have been welded together at various points to form the bar. Such scrap feed material bars can be, for example, about 30 inches×30 inches in cross section, and about 240 inches in length. It is difficult to add powdered titanium oxide master alloy to the bars. For example, placing or pouring the titanium dioxide powder directly on the porous bars results in the powder falling through the scrap material and contaminating the preparation area.

According to one non-limiting aspect of the present disclosure, long rods or other elongate formed articles comprised of one or more particulate master alloys and binder material can be fabricated. The articles may be made so as to include known weights of the one or more particulate master alloys per unit length. Certain lengths of the elongate formed articles may be included in titanium scrap material bars, such as the bar shown in FIG. 2, during bar fabrication so that a bar would include the desired concentration of alloying materials relative to the titanium content of the bar, and the elongate geometry of the article would help to suitably distribute the alloying additives along the length of the bar. In cases where relatively high concentrations of alloying elements are required, multiple lengths of the elongate formed articles could be included in a single bar. Also, the elongate formed articles could be manufactured in several varieties differing in weight of master alloy per unit length so as to allow for more precise addition of the alloying additives depending on the particular alloy to be melted. Of course, it will be understood that such elongate master alloy/binder articles are not limited to use in producing titanium alloys and may be adapted for use in the production of other alloys and for other suitable uses.

Another embodiment of elongate particulate master alloy/binder formed articles according to the present disclosure could be manufactured as a sheet in a size (length×width) specific to the size of all or a region of a surface of the prepared feed materials. For example, with respect to the 30×30×240 inch bars of titanium feed materials mentioned above and depicted in FIG. 2, formed articles including particulate titanium dioxide master alloy could be made in a sheet form with a size of about 30×240×⅛ inch and placed on a complementary sized 30×240 inch face of the titanium scrap bar. One benefit to this embodiment is that the sheet-shaped formed article would contribute to the mechanical strength of the bar and thereby improve the bar's resistance to damage upon handling. Whether the elongate formed articles are associated with the bars of scrap feed material in the form of rods or sheets, the formed article could be positioned on or within the bar so that the titanium dioxide and the polymer or other binder material ingredients in the formed article melt substantially evenly as the bar is incrementally melted by, for example, electron beam guns. In such case, the alloying additives in the formed article would mix homogenously and in the desired concentration into the resultant molten stream as the bar melts. As with the previous example, formed articles made in the shape of relatively thin sheets could be used in the production of alloys other than titanium alloys.

Following are several examples illustrating certain aspects of non-limiting embodiments of certain formed articles within the present disclosure. It will be understood that the following examples are merely intended to illustrate certain embodiments of the formed articles, and are not intended to limit the scope of the present disclosure in any way. It will also be understood that the full scope of the inventions encompassed by the present disclosure is better indicated by the claims appended to the present description.

EXAMPLE 1

A study was conducted to evaluate an embodiment of a formed article prepared according to the present disclosure. Three buttons were prepared by melting and casting starting materials. A first test button (Button #1) was cast from a melt of 800 grams of ASTM grade 2 titanium sheet clips generally having a size of 2×2×⅛ inch. A second test button (Button #2) was prepared by melting a mixture of 800 grams of the same titanium sheet clips and 1 gram of DuPont Ti-PURE® R-700 rutile titanium dioxide powder having an average particle size of about 0.26 micrometer. A third test button (Button #3) was prepared from a melt prepared from 800 grams of the same titanium sheet clips, to which was added 1 gram of pellets formed from titanium dioxide powder bound in the pellets by an ethylene vinyl acetate (EVA) polymer binder. The pellets of titanium dioxide/EVA binder, depicted in FIG. 3, which were obtained from a polymer manufacturer, were roughly spherical, ranged from about 2 to about 10 mm in diameter, and included about 70 wt. % particulate titanium dioxide and about 30 wt. % of EVA as binder binding the titanium dioxide particles.

The pelleted titanium dioxide/EVA material used in the present example is commercially available as a white pigment additive for use in the plastic injection industry. To the present inventors' knowledge, the material has not been promoted, marketed, or suggested for the purpose of alloying metal melts. Thus, it is believed that such material produced for the purpose of alloying metal melts has not been offered or sold. Various types of pellets including titanium dioxide and polymer binder intended for addition of white pigment in plastics production are available from several large-scale polymer manufacturers. Certain of these white pigment pellets meet the binder material requirements discussed herein and could be used as master alloy/binder formed articles according to the metal melt alloying methods described herein. The titanium dioxide loadings in the commercially available titanium dioxide polymer pellets, however, are lower than optimal (typically about 70 wt. % titanium dioxide). A higher loading of titanium dioxide or some other master alloy is preferred in formed articles made or used according to the present disclosure and including organic polymer binder material because this reduces the carbon concentration of the formed articles. The commercially available titanium dioxide/organic polymer binder pellets typically have a diameter of about 5 mm, which should mix well with, for example, metal melt raw feed materials having about the same size. Typical titanium raw feed materials, however, are around 50 mm in diameter, so it would be preferred to form the commercially available 5 mm diameter titanium dioxide/organic polymer pellets into larger shapes so as to better mix with the 50 mm titanium raw feed materials. Manufacturers of commercially available titanium dioxide/organic polymer pigment pellets may be consulted to possibly obtain pellets in custom sizes and with preferred characteristics for use as master alloy-containing formed articles in the alloying methods disclosed herein.

A conventional titanium button melter was used to prepare the buttons. As is known in the art, a button melter is basically a large TIG welding unit with the welding area enclosed in an inert environment. A positive pressure of argon gas is maintained in the welding area and prevents contamination by oxygen and nitrogen from the air. The button melter used in the present example is capable of melting buttons ranging from 10 grams to 2 kilograms. An arc is formed with the materials to be melted and forms a molten pool. The molten pool then solidifies into a button, and the button is turned and melted again several times to assure uniformity throughout the button. The buttons are removed through an air lock after cooling.

The materials were observed during the melting of Buttons #2 and #3 to determine how well the titanium dioxide dissolved in the samples. Button #also was observed to assess whether an unacceptable amount of hydrogen gas was evolved during decomposition of the binder. EVA has the chemical formula $CH_2CHOOCCH_3$ and an atomic weight of 86. The organic polymeric material is 56 wt. % carbon, 26 wt. % oxygen, and 7 wt. % hydrogen. Upon its decomposition at the high temperatures used to melt the feed materials, the liberated oxygen dissolves in the melt, while the relatively small amount of liberated hydrogen is largely gassed off into the atmosphere above the melt. The carbon liberated on decomposing the binder dissolves in the melt and alloys the titanium, increasing its strength.

To ensure that an excessive amount of carbon does not dissolve in the melt when alloying titanium using a titanium dioxide/organic polymer formed article according to the present disclosure, one preferably will select a formed article that includes sufficient oxygen to desirably alloy the titanium, without simultaneously introducing too great a concentration of carbon into the melt. Thus, although a titanium dioxide/organic polymer binder master alloy including 30 wt. % EVA was used in the present example, alternative binder materials could be used if the tolerance for carbon addition in the alloy requires as much. Such alternative materials may include, for example, wax, a lower molecular weight organic polymer binder concentration and/or an organic polymer binder having lower carbon content than EVA.

Upon melting the materials to make Button #3, none of the titanium dioxide/binder pellets and none of the titanium dioxide powder included in the pellets was observed floating on the top of the melt. This observation is some evidence that the titanium dioxide particles included in the pellets were fully absorbed in the melt. The organic polymer in the pellets was observed to turn black and molten during melting as the binder decomposed. The amount of hydrogen gas evolved during decomposition of the binder was not considered to be problematic. During preparation of Button #2, it was similarly observed that none of the titanium dioxide powder particles in the starting materials floated on the top of the melt. Of course, the volume of material melted to form each button was limited, and it is believed that problems with incomplete incorporation of titanium dioxide powder into the melt are more likely to occur with higher volumes of molten material.

Table 1 below shows the measured carbon, oxygen, and nitrogen concentrations of the three test buttons, as well as predicted concentrations of these elements for Buttons #2 and #3. The predicted concentrations were calculated based on the known carbon and oxygen concentrations in the EVA binder and the known oxygen concentration in the titanium dioxide powder.

TABLE 1

| Material | Carbon (wt. %) | Oxygen (wt. %) | Nitrogen (wt. %) |
|---|---|---|---|
| Button #1 (standard Ti) | 0.016 | 0.151 | 0.008 |
| Actual Chemistry Button #2 (Ti + powdered $TiO_2$) | 0.016 | 0.192 | 0.006 |
| Predicted Chemistry Button #2 | 0.016 | 0.201 | 0.008 |
| Actual Chemistry Button #3 (Ti + powdered $TiO_2$) | 0.030 | 0.192 | 0.006 |
| Predicted Chemistry Button #3 | 0.037 | 0.196 | 0.008 |

Figure 3:
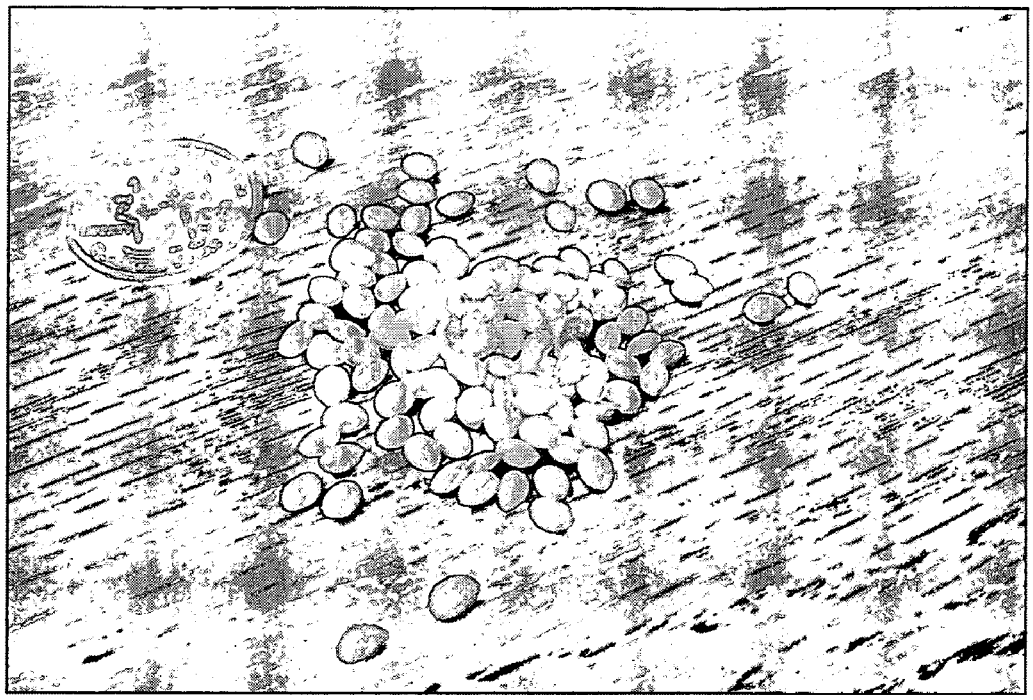
FIG. 3 is a photograph of pelleted articles including titanium dioxide and an ethylene vinyl acetate binder and which may be used in certain non-limiting embodiments of the method according to the present disclosure.

Commercially available 70 wt. % titanium dioxide/EVA pellets, as shown in FIG. 3, were utilized in the present example. Accordingly, the present disclosure also encompasses as inventive the method of using as alloying additives in metallic melts commercially available materials having the composition and construction of formed articles according to the present disclosure. As noted above, it is believed that such pelleted materials have not been offered or sold as alloying additives for metal melts, but instead have been sold as pigment additives for plastics production. Also, it will be understood that embodiments of pellets including particulate master alloy and binder differing in one or more respects from the 70 wt. % titanium dioxide/EVA pellets in the present example can be made or otherwise obtained. Such embodiments could include, for example, different master alloys and/or different binder materials, may be of differing shapes and/or sizes, and could be manufactured by a variety of techniques. Such pellets could be made using, for example, extrusion or injection molding technologies. Other possibilities will be readily apparent to those having ordinary skill upon considering the present disclosure.

Formed articles made in pellet shapes according to the present disclosure may be used in a number of ways. For example, the pellets may be homogeneously mixed with the melt feed materials prior to introducing the mixture into the furnace. Another possible technique involves feeding the pellets directly into the furnace in synchronized fashion with raw melt feed materials just before the combined materials enter the hearth for melting. Preferably, the pellets will be of a size and/or density similar to the individual pieces of feed raw feed material to which the pellets are added so as to improve mixing of the pellets and raw feed materials.

EXAMPLE 2

Formed articles within the scope of the present disclosure were made using DuPont Ti-PURE® titanium dioxide powder having a narrow particle size distribution and an average particle diameter of 0.26 micrometers. The binder material used was LDPE. A titanium dioxide loading of 82 wt. % was used, as it was believed to provide a good potential to allow the titanium dioxide/binder mixture to be extruded successfully into a formed article. In addition, the relatively low 18 wt. % binder content was believed to be advantageous in that it restricted the carbon concentration of the formed articles. The titanium dioxide and LDPE powders were homogenously mixed in a rotating cylinder for about 4 hours. During mixing, the materials were heated to a temperature above the melting point of the LDPE so that the liquefied LDPE coated the oxide particles.

Figure 4:
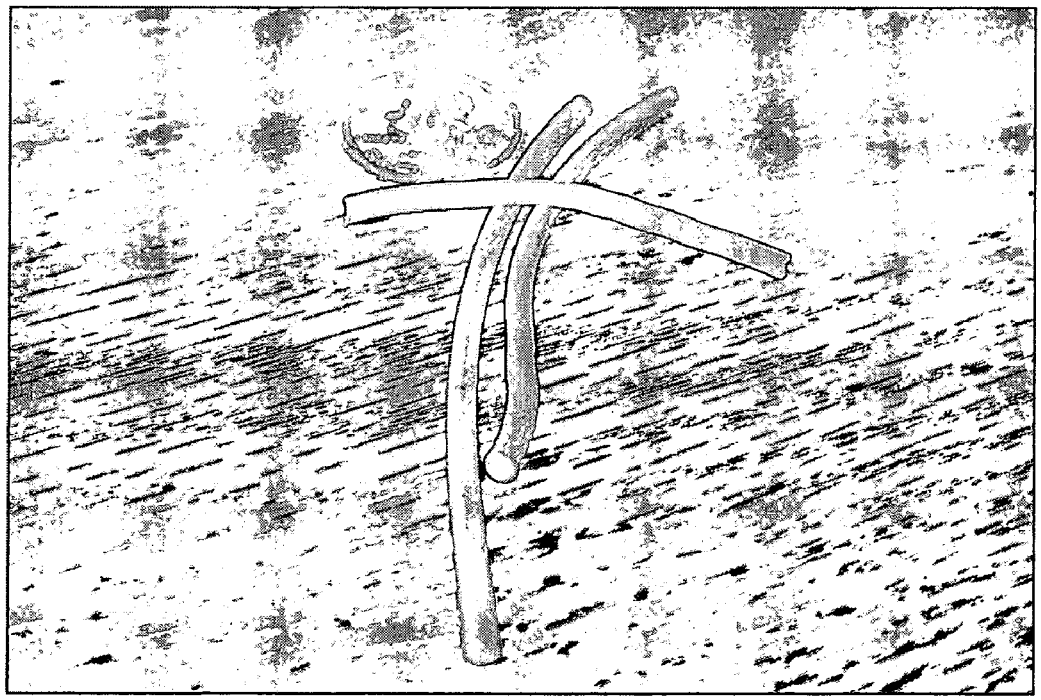
FIG. 4 is a photograph of extruded cylindrical formed articles including titanium dioxide and a LDPE binder made according to the present disclosure.

The heated mixture of titanium dioxide and LDPE was then extruded. The extrusion can be done using any suitable extrusion apparatus, such as a single screw or twin-screw extruder. The heated mixture was extruded into extended cylindrical shapes of varying lengths and having a diameter of either 3 mm or 9 mm. FIG. 4 is a photograph of certain of the 3 mm diameter rod-shaped cylindrical extrusions made according to this example. The extrusions could be used in a number of ways. For example, for addition to cobble sized raw feed materials, the extruded rods could be formed into long lengths of, for example, up to about 100 mm in diameter and up to about 10 meters in length. Lengths of the extruded material could be cut into smaller lengths between, for example, about 10 and about 100 mm, and mixed with the raw feed materials. For addition with bar-shaped raw feed materials, such as the bars shown in FIG. 2, the extruded rods could be cut into lengths of between about 300 and about 4000 mm and added to the melt by incorporating the lengths into the raw feed material bars. Although the formed articles shown in FIG. 4 have simple cylindrical shapes, it will be understood that extruded shapes may have any size and cross-sectional shape that can be achieved using extrusion equipment and extrusion dies suitable for producing formed shapes from the master alloy/binder mixtures described herein. Non-limiting examples of alternative cross-sectional shapes for the extrusions include rectangular shapes, cross shapes, and other shapes including multiple arms. In addition, although FIG. 4 depicts elongated cylindrical shapes, it will be understood that such shapes may be cut into smaller lengths, or even into small pieces, using suitable equipment. Of course, although extrusion equipment was used in this example to produce the formed shapes, other forming equipment such as, for example, die presses, injection presses, and pelleting machines, could be used, and that the resulting formed articles may be made with any suitable shape.

Figure 5:
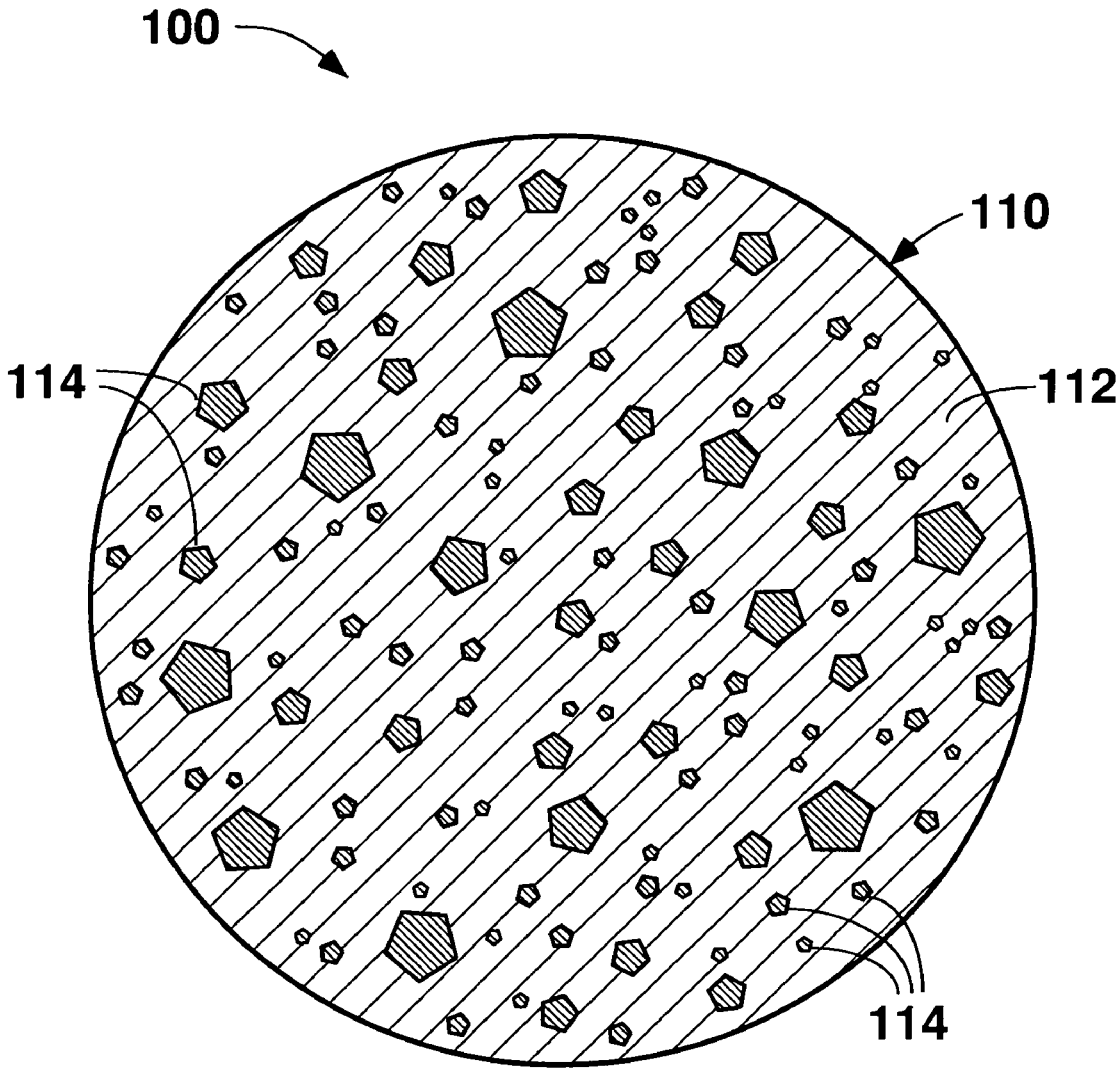
FIG. 5 is a schematic cross-sectional view of an embodiment of an extruded cylindrical formed article according to the present disclosure.

FIG. 5 is a schematic cross-sectional view of one of the extruded cylindrical formed articles made in the present example. The formed article 100 includes circular perimeter 110 surrounding a continuous matrix phase 112 of LDPE binder material and a discontinuous phase of titanium dioxide particles 114 distributed within the matrix phase. The binder phase 112 binds together the titanium dioxide particles 114, but decomposes and frees the particles 114 when subjected to the high melting temperatures used to form the metal melt. The prevalence of titanium dioxide particles 114 in the matrix phase is proportional to the concentration of master alloy per unit length of the formed article 100.

The rod-shaped formed articles according to the present example may be used in a variety of manners, including the following non-limiting examples.

The rod-shaped formed articles of this example may be cut into short lengths, and the resulting pieces may be added to scrap or other melt feed materials using a variety of techniques. For example, as mentioned above, the cut lengths may be substantially homogenously mixed with the raw feed materials before the combined materials are fed into the furnace. Alternatively, the cut lengths may be fed through, for example, master alloy bins so as to automatically add to the scrap material in predetermined metered proportions, or the cut lengths may be fed directly into the furnace in synchronized fashion with the raw material feed before the combined materials enter the hearth and begin to melt. The cut lengths preferably are sized to promote homogenous mixing and inhibit segregation when the combined materials are handled or jostled. For example, 3 mm or 9 mm extrusions of particulate titanium dioxide and LDPE binder according to the present example may be cut into lengths, and the pieces may be added to titanium sponge and/or cobble and mixed together in a twin cone mixer or other suitable mixing apparatus. If the titanium sponge and/or cobble pieces are, for example, approximately 2 to 4 inches, then the 9 mm diameter rod-shaped formed article could be cut into lengths of approximately 4 inches. Or if the titanium sponge and/or cobble pieces are, for example, approximately 0.1 inch to 2 inches, then the 3 mm or 9 mm rod-shaped formed article could be cut into lengths of approximately 0.5 inch. Such non-limiting combinations appear to promote homogenous mixing and also appear to inhibit later segregation.

The rod-shaped formed articles according to the present example also may be cut into multiple-foot lengths and added to bars made from scrap solids, such as the bar shown in FIG. 2. The lengths may be placed the entire length of the bar or only in needed sections or regions of the bar. For example, the 3 mm and/or 9 mm extrusions of particulate titanium dioxide and LDPE binder made in the present example may be cut into 5 to 20 foot lengths and included in bars formed of titanium scrap solids used in producing titanium alloys.

As noted herein, the specific examples of formed articles described herein should not be considered to limit the breadth of the following claims. For instance, the formed articles could be produced in a variety of forms not specifically mentioned herein.

Although the foregoing description has necessarily presented a limited number of embodiments of the invention, those of ordinary skill in the relevant art will appreciate that various changes in the components, compositions, details, materials, and process parameters of the examples that have been herein described and illustrated in order to explain the nature of the invention may be made by those skilled in the art, and all such modifications will remain within the principle and scope of the invention as expressed herein and in the appended claims. It will also be appreciated by those skilled in the art that changes could be made to the embodiments described above without departing from the broad inventive concept thereof. It is understood, therefore, that this invention is not limited to the particular embodiments disclosed, but it is intended to cover modifications that are within the principle and scope of the invention, as defined by the claims.

We claim:

1. A formed article for making alloying additions to metal melts, the formed article comprising:

titanium dioxide particles; and a binder material binding the titanium dioxide particles in the formed article, wherein the binder material is capable of changing form and freeing the titanium dioxide particles when the formed article is heated to a predetermined temperature that is greater than 500° F., and further wherein the formed article comprises at least 18% by weight of the binder material.

2. The formed article of claim 1, wherein the formed article has at least one of a predetermined density, a predetermined shape, and a predetermined size.

3. The formed article of claim 1, wherein the formed article has a shape selected from the group consisting of a pellet, a stick, a rod, a bar, a curved shape, a star shape, a branching shape, a polyhedron, a parabola, a cone, a cylinder, a sphere, an ellipsoid, a shape including multiple protrusions, a shape including multiple curved surfaces, a shape including multiple angles, a jack shape, a sheet, and a right angle shape.

4. The formed article of claim 1, wherein the formed article has a diameter no greater than about 100 mm.

5. The formed article of claim 1, wherein the formed article has a diameter no greater than about 3 mm.

6. The formed article of claim 1, wherein the formed article has a diameter no greater than about 1 mm.

7. The formed article of claim 1, wherein the binder material comprises at least one organic polymer.

8. The formed article of claim 1, wherein the binder material is at least one organic polymer selected from the group consisting of thermoplastic polymers, thermoset polymers, ethylene vinyl acetate, polyethylene, low density polyethylene, high density polyethylene, urea formaldehyde, and formaldehyde compounds.

9. The formed article of claim 7, wherein the article comprises at least 18% up to 60% by weight of the binder material.

10. The formed article of claim 1, wherein the formed article has a known carbon content.

11. The formed article of claim 1, wherein the formed article comprises a curved "C" shape.

12. A method of making an article for alloying a metal melt, the method comprising:

providing a substantially homogenous mixture comprising titanium dioxide particles and a binder material, wherein the mixture comprises at least 18% by weight of the binder material; and forming an article from at least a portion of the mixture, the article comprising titanium dioxide particles bound in the formed article by the binder material;

wherein the binder material is capable of changing form and freeing the titanium dioxide particles when the article is heated to a predetermined temperature that is greater than 500° F.

13. The method of claim 12, wherein the binder material comprises at least one organic polymer.

14. The method of claim 13, wherein the method further comprises heating the mixture at least one of prior to and simultaneous with forming the article from at least a portion of the mixture.

15. The method of claim 13, wherein the organic polymer is a thermoset polymer, and further wherein forming the article comprises curing the polymer.

16. The method of claim 12, wherein the article has a shape selected from the group consisting of a pellet, a stick, a rod, a bar, a curved shape, a star shape, a branching shape, a polyhedron, a parabola, a cone, a cylinder, a sphere, an ellipsoid, a shape including multiple protrusions, a shape including multiple curved surfaces, a shape including multiple angles, a jack shape, a sheet, and a right angle shape.

17. The method of claim 12, wherein the article has at least one of a predetermined density, a predetermined shape, and a predetermined size.

18. The method of claim 12, wherein the article has a diameter no greater than about 100 mm.

19. The method of claim 12, wherein the article has a diameter no greater than about 3 mm.

20. The method of claim 12, wherein the article has a diameter no greater than about 1 mm.

21. The method of claim 13, wherein the organic polymer is at least one material selected from the group consisting of thermoplastic polymers, thermoset polymers, ethylene vinyl acetate, polyethylene, low density polyethylene, high density polyethylene, urea formaldehyde, and formaldehyde compounds.

22. The method of claim 12, wherein the article includes at least 18% up to 60% by weight of organic polymer.

23. The method of claim 12, wherein the article has a known concentration of carbon.

24. The method of claim 12, wherein forming the article from at least a portion of the mixture comprises at least one technique selected from the group consisting of casting, die molding, extruding, injection molding, pelleting, and film extruding.

25. A method of making an alloy, the method comprising:

preparing a substantially homogenous mixture comprising raw feed material and a quantity of formed articles, the formed articles comprising a predetermined quantity of a master alloy selected from the group consisting of titanium, titanium compounds, titanium dioxide, nickel, nickel compounds, molybdenum, molybdenum compounds, palladium, palladium compounds, aluminum, aluminum compounds, vanadium, vanadium compounds, tin, tin compounds, chromium, chromium compounds, iron, iron oxide, and iron compounds, wherein the formed articles comprise particles of the master alloy bound together by a binder material that is capable of decomposing at a predetermined temperature that is greater than 500° F. and releasing the particles of master alloy, and wherein the formed articles comprise at least 18% by weight of the binder material; and subsequent to preparing the substantially homogenous mixture, heating at least a portion of the mixture at a temperature at least as great as the predetermined temperature to release the particles of the master alloy in the formed articles and provide a melt.

26. The method of claim 25, wherein preparing the substantially homogenous mixture comprises adding a plurality of the formed articles in a controlled manner to a stream of at least a portion of the raw feed material prior to melting at least a portion of the substantially homogenous mixture.

27. The method of claim 25, wherein the formed articles have at least one of a predetermined size, a predetermined shape, and a predetermined density.

28. The method of claim 25, wherein the binder material comprises at least one organic polymer.

29. The method of claim 28, wherein the organic polymer decomposes when heated to the predetermined temperature and liberates at least one of carbon, oxygen, and nitrogen that is absorbed into the melt.

30. The method of claim 28, wherein the alloy is a titanium alloy.

31. The method of claim 30, wherein the raw feed material comprises at least one of titanium cobble and titanium sponge.

32. The method of claim 25, wherein the formed articles have a shape selected from the group consisting of a pellet, a stick, a rod, a bar, a curved shape, a star shape, a branching shape, a polyhedron, a parabola, a cone, a cylinder, a sphere, an ellipsoid, a shape including multiple protrusions, a shape including multiple curved surfaces, a shape including multiple angles, a jack shape, a sheet, and a right angle shape.

33. The method of claim 25, wherein the formed articles have a diameter no greater than about 100 mm.

34. The method of claim 25, wherein the formed articles have a diameter no greater than about 3 mm.

35. The method of claim 25, wherein the formed articles have a diameter no greater than about 1 mm.

36. The method of claim 28, wherein the organic polymer is at least one material selected from the group consisting of thermoplastic polymers, thermoset polymers, ethylene vinyl acetate, polyethylene, LDPE, HDPE, urea formaldehyde, and formaldehyde compounds.

37. The method of claim 28, wherein the formed article includes at least 18% up to 60% by weight of organic polymer binder material.

38. The method of claim 28, wherein the formed article has known concentrations of carbon and titanium.

39. A method of adjusting the elemental composition of a metal melt, the method comprising:

including in the melt a predetermined quantity of a master alloy in the form of at least one formed article including particles of master alloy bound together by at least one organic polymer, wherein the formed article comprises at least 18% by weight of the at least one organic polymer, wherein the master alloy comprises at least one of titanium, titanium compounds, nickel, nickel compounds, molybdenum, molybdenum compounds, palladium, palladium compounds, aluminum, aluminum compounds, vanadium, vanadium compounds, tin, tin compounds, chromium, chromium compounds, iron, iron oxide, and iron compounds.

40. The method of claim 39, wherein including in the melt a predetermined quantity of the master alloy comprises including a plurality of the formed articles in the melt.

41. The method of claim 40, wherein the formed articles have at least one of a predetermined density, a predetermined shape, and a predetermined size.

42. The method of claim 41, wherein the formed articles have a shape selected from the group consisting of a pellet, a stick, a rod, a bar, a curved shape, a star shape, a branching shape, a polyhedron, a parabola, a cone, a cylinder, a sphere, an ellipsoid, a shape including multiple protrusions, a shape including multiple curved surfaces, a shape including multiple angles, a jack shape, a sheet, and a right angle shape.

43. The method of claim 41, wherein the formed articles have a diameter no greater than about 100 mm.

44. The method of claim 41, wherein the formed articles comprise titanium dioxide and have a diameter no greater than about 3 mm.

45. The method of claim 41, wherein the formed articles comprise titanium dioxide and have a diameter no greater than about 1 mm.

46. The method of claim 40, wherein the formed articles include at least one organic polymer selected from the group consisting of thermoplastic polymers, thermoset polymers, ethylene vinyl acetate, polyethylene, low density polyethylene, high density polyethylene, urea formaldehyde, and formaldehyde compounds.

47. The method of claim 40, wherein the formed articles comprise at least 18% up to 60% by weight of the at least one organic polymer.

48. The method of claim 40, wherein the formed articles comprise a known carbon content.

49. A formed article for making alloying additions to metal melts, the formed article comprising:

titanium dioxide particles; and a binder material comprising at least one organic polymer selected from the group consisting of thermoplastic polymers, thermoset polymers, ethylene vinyl acetate, polyethylene, low density polyethylene, high density polyethylene, urea formaldehyde, and formaldehyde compounds, the binder material binding the titanium dioxide particles in the formed article, wherein the binder material is capable of changing form and freeing the titanium dioxide particles when the formed article is heated to a predetermined temperature that is greater than 500° F., and further wherein the formed article comprises at least 18% by weight of the binder material.

50. The formed article of claim 49, wherein the formed article has at least one of a predetermined density, a predetermined shape, and a predetermined size.

51. The formed article of claim 49, wherein the formed article has a shape selected from the group consisting of a pellet, a stick, a rod, a bar, a curved shape, a star shape, a branching shape, a polyhedron, a parabola, a cone, a cylinder, a sphere, an ellipsoid, a shape including multiple protrusions, a shape including multiple curved surfaces, a shape including multiple angles, a jack shape, a sheet, and a right angle shape.

52. The formed article of claim 49, wherein the formed article has a diameter no greater than about 100 mm.

53. The formed article of claim 49, wherein the formed and has a diameter no greater than about 3 mm.

54. The formed article of claim 49, wherein the formed article and has a diameter no greater than about 1 mm.

55. The formed article of claim 49, wherein the formed article comprises at least 18% up to 60% by weight of the binder material.

56. The formed article of claim 49, wherein the formed article has a known carbon content.

57. A method of making a formed article for alloying a metal melt, the method comprising:

providing a substantially homogenous mixture comprising titanium dioxide particles and a binder material, wherein the binder material comprises at least one organic polymer selected from the group consisting of thermoplastic polymers, thermoset polymers, ethylene vinyl acetate, polyethylene, low density polyethylene, high density polyethylene, urea formaldehyde, and formaldehyde compounds, and wherein the mixture comprises at least 18% by weight of the binder material; and forming an article from at least a portion of the mixture, the article comprising titanium dioxide particles bound in the article by the binder material;

wherein the binder material is capable of changing form and freeing the titanium dioxide particles when the article is heated to a predetermined temperature that is greater than 500° F.

58. The method of claim 57, wherein the method further comprises heating the mixture at least one of prior to and simultaneous with forming the article from at least a portion of the mixture.

59. The method of claim 57, wherein the organic polymer is a thermoset polymer, and further wherein forming the article comprises curing the organic polymer.

60. The method of claim 57, wherein the article has a shape selected from the group consisting of a pellet, a stick, a rod, a bar, a curved shape, a star shape, a branching shape, a polyhedron, a parabola, a cone, a cylinder, a sphere, an ellipsoid, a shape including multiple protrusions, a shape including multiple curved surfaces, a shape including multiple angles, a jack shape, a sheet, and a right angle shape.

61. The method of claim 57, wherein the article has at least one of a predetermined density, a predetermined shape, and a predetermined size.

62. The method of claim 57, wherein the article has a diameter no greater than about 100 mm.

63. The method of claim 57, wherein the article has a diameter no greater than about 3 mm.

64. The method of claim 57, wherein the article has a diameter no greater than about 1 mm.

65. The method of claim 57, wherein the article includes at least 18% up to 60% by weight of the organic polymer.

66. The method of claim 57, wherein the article has a known concentration of carbon.

67. The method of claim 57, wherein forming the article from at least a portion of the mixture comprises at least one technique selected from the group consisting of casting, die molding, extruding, injection molding, pelleting, and film extruding.

68. A method of making an alloy, the method comprising:

preparing a substantially homogenous mixture comprising a raw feed material and a quantity of formed articles, each of the formed articles comprising a predetermined quantity of a master alloy selected from the group consisting of titanium, titanium compounds, titanium dioxide, nickel, nickel compounds, molybdenum, molybdenum compounds, palladium, palladium compounds, aluminum, aluminum compounds, vanadium, vanadium compounds, tin, tin compounds, chromium, chromium compounds, iron, iron oxide, and iron compounds, wherein each of the formed articles comprises particles of the master alloy bound together by a binder material that is capable of decomposing at a predetermined temperature that is greater than 500° F. and releasing the particles of master alloy, and wherein each of the formed articles comprises at least 18% by weight of the binder material; and simultaneous with preparing the substantially homogenous mixture, heating at least a portion of the mixture at a temperature at least as great as the predetermined temperature to provide a melt.

69. The method of claim 68, wherein preparing the substantially homogenous mixture comprises adding a plurality of the formed articles in a controlled manner to a stream of at least a portion of the raw feed material.

70. The method of claim 68, wherein the formed articles have at least one of a predetermined size, a predetermined shape, and a predetermined density.

71. The method of claim 68, wherein the binder material comprises at least one organic polymer.

72. The method of claim 68, wherein the binder material is at least one organic polymer selected from the group consisting of thermoplastic polymers, thermoset polymers, ethylene vinyl acetate, polyethylene, low density polyethylene, high density polyethylene, urea formaldehyde, and formaldehyde compounds.

73. The method of claim 72, wherein the organic polymer decomposes when heated to the predetermined temperature and liberates at least one of carbon, oxygen, and nitrogen that is absorbed into the melt.

74. The method of claim 68, wherein the raw feed material comprises at least one of titanium cobble and titanium sponge.

* * * * *